US005494021A

United States Patent [19]

Yoneyama

[11] Patent Number: 5,494,021

[45] Date of Patent: Feb. 27, 1996

[54] EVAPORATIVE PURGE MONITORING METHOD AND SYSTEM

[75] Inventor: Shuichi Yoneyama, Kanagawa, Japan

[73] Assignee: Nissan Motor Co., Ltd., Yokohama, Japan

[21] Appl. No.: 305,941

[22] Filed: Sep. 15, 1994

[51] Int. Cl.[6] ..... F02M 33/02

[52] U.S. Cl. ..... 123/520

[58] Field of Search ..... 123/516, 518, 123/519, 520, 198 D

[56] References Cited

U.S. PATENT DOCUMENTS 5,261,379 11/1993 Lipinski et al. ..... 123/520
5,279,529 3/1994 Cook et al. ..... 123/520
5,295,472 3/1994 Otsuka et al. ..... 123/520
5,355,863 10/1994 Yamanaka et al. ..... 123/520
5,355,864 10/1994 Kuroda et al. ..... 123/520
5,359,978 11/1994 Kidokoro et al. ..... 123/520
5,373,823 12/1994 Kuroda et al. ..... 123/520
5,398,661 3/1995 Denz et al. ..... 123/520

*Primary Examiner*—Thomas N. Moulis
*Attorney, Agent, or Firm*—Lowe, Price, LeBlanc & Becker

[57] ABSTRACT

According to an evaporative purge system monitor strategy, a vacuum application phase is initiated by closing a canister vent valve and opening a canister purge valve if entry conditions are met in order to apply a vacuum to an evaporative purge flow path, and identification is made of a clog in the evaporative purge flow path if a target vacuum is not reached within a vacuum build time during the vacuum application phase and a preset vacuum is not reached after elapse of the vacuum build time.

5 Claims, 3 Drawing Sheets

EVAPORATIVE PURGE MONITORING METHOD AND SYSTEM

BACKGROUND OF THE INVENTION

The present invention relates to managing an evaporative purge system for a vehicle having a fuel tank connected to an internal combustion engine.

Various techniques for monitoring the evaporative purge system are proposed in copending U.S. patent application Ser. No. 08/153,516 (attorney docket No. 305–411) filed on Nov. 17, 1993, now U.S. Pat. No. 5,408,866, which copending application has been commonly assigned herewith.

It is desirable to be able to test the purge flow path to identify not only leaks but also clogs.

SUMMARY OF THE INVENTION

The invention tests the purge flow path of an evaporative purge system to identify clogs.

According to the invention, there is provided an evaporative purge system for an engine having an air induction passage, comprising:

a canister having a canister vent valve;

a fuel tank coupled to said canister;

a purge line connected to said canister;

a canister purge valve fluidly connected between said purge line and the induction passage; and a diagnostic means operative to close said canister vent valve and open said canister purge valve if predetermined entry conditions are met in order to apply a vacuum to an evaporative purge flow path to initiate a vacuum application phase, said diagnostic means being operative to identify a clog in the evaporative purge flow path if a target vacuum is not reached within a target vacuum build time during the vacuum application phase and a preset vacuum, which is less negative pressure than the target vacuum, is not reached after elapse of the target vacuum build time.

According to another aspect of the invention, there is provided a method of monitoring an evaporative purge flow path, comprising the steps of:

closing a canister vent valve to the atmosphere;

applying a vacuum to the evaporative purge flow path;

waiting a target vacuum build time;

determining whether a target vacuum has been reached within the target vacuum build time;

determining whether a preset vacuum, which is less negative pressure than the target vacuum, is reached after elapse of the target vacuum build time if the target vacuum is not reached within the target vacuum build time; and identifying a clog in the evaporative purge flow path if the preset vacuum is not reached after elapse of the target vacuum build time.

DETAILED DESCRIPTION OF TEE INVENTION

Figure 1:
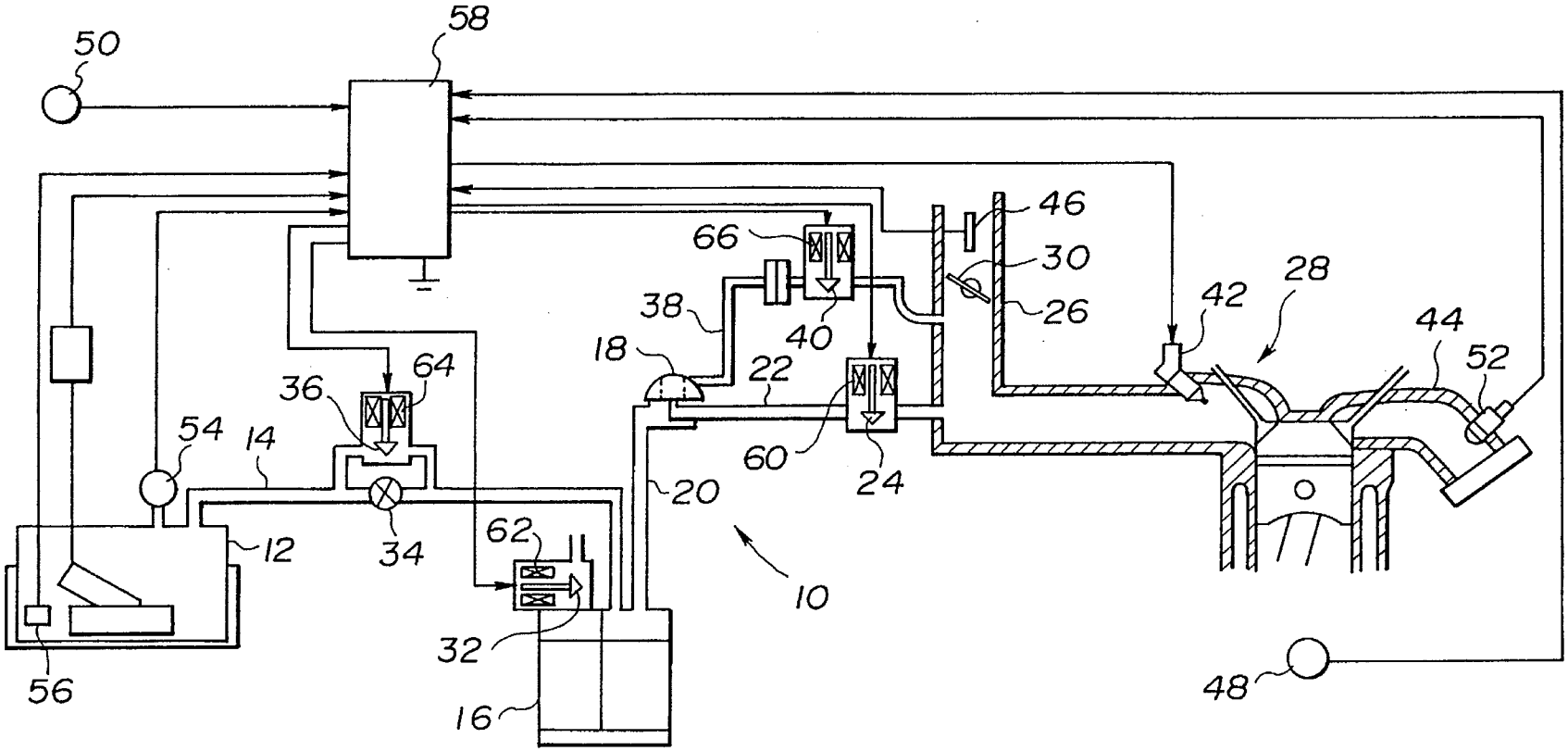
FIG. 1 is a block diagram of an evaporative purge system.

Referring to FIG. 1, an evaporative purge system includes a fuel tank 12 which is connected to an evaporative fuel vapor line 14 coupled to a charcoal canister 16. A diaphragm actuated valve 18 is remotely mounted and connected by a line 20 to the canister 16 although it may be directly mounted to the canister 16. Through the diaphragm actuated valve 18, the canister 16 is connected to an evaporative purge line 22 which is connected through a canister purge valve 24 to an air induction passage 26 of an internal combustion engine 28 of the fuel injection type at a location downstream of a throttle valve 30. The canister 16 is connected to atmosphere through a canister vent valve 32. A check valve 34 is arranged to prevent return flow of fuel vapor to the fuel tank 12 through the fuel vapor line 14. A bypass valve 36 is connected in parallel to the check valve 34. The diaphragm actuated valve 18 has a servo chamber connected to a vacuum line 38 which is in turn connected through a purge shut off valve 40 to the induction passage 26.

The engine 28 has a plurality of fuel injectors, only one being shown at 42 and an exhaust passage 44 provided with a catalytic converter, not shown. An air flow sensor 46 is arranged to provide a signal representative of a vacuum induced by an air flow in the induction passage 26. A crank angle sensor 48 is coupled with a camshaft, not shown, and provides clock pulses indicative of a particular position of a crankshaft, not shown. A temperature sensor 50 is arranged to provide a signal indicative of temperature of the engine coolant. An oxygen sensor 52 is arranged to provide a signal indicative of oxygen concentration in the engine exhaust gas. A pressure sensor 54 is connected to the fuel tank 12 to provide a signal indicative of fuel tank pressure. A fuel temperature sensor 56 is installed directly into the fuel tank 12 to provide a signal indicative of fuel temperature.

The signals of the air flow sensor 46, crank angle sensor 48, coolant temperature sensor and oxygen sensor 52 are fed to a control unit 58. With the information derived from these signals, the control unit 58 can calculate a fuel injection amount and outputs a control signal which governs the fuel injectors 42.

With the information from the coolant temperature sensor 50 and fuel temperature sensor 56, the control unit 58 can determine whether predetermined entry conditions are met for conducting a diagnostic test.

The canister purge valve 24 is of the normally closed type and opened by a solenoid driver 60. The canister vent valve 32 is of the normally open type and closed by a solenoid driver 62. The bypass valve 36 is of the normally closed type and opened by a solenoid driver 64. The purge shut off valve 40 is of the normally closed type and opened by a solenoid driver 66. All of these solenoid drivers 60, 62, 64 and 66 are controlled by the control unit 58.

During a normal purge operation, the purge shut off valve 40 is opened to apply vacuum to the servo chamber of the diaphragm actuated valve 18 and canister purge valve 24 is opened, while the canister vent valve 32 remains opened and bypass valve 36 remains closed. When, during engine operation, vacuum in the induction passage 26 is high or strong enough to hold the valve 18 at its open position, the canister purge line 22 is opened to communicate with the line 20. Thus, the purge gas is allowed to pass through the line 20 and purge line 22 into the induction passage 26 since the canister vent valve 32 is opened to allow entry of fresh air into the canister 16 and the canister purge valve 24 is opened.

Figure 3:
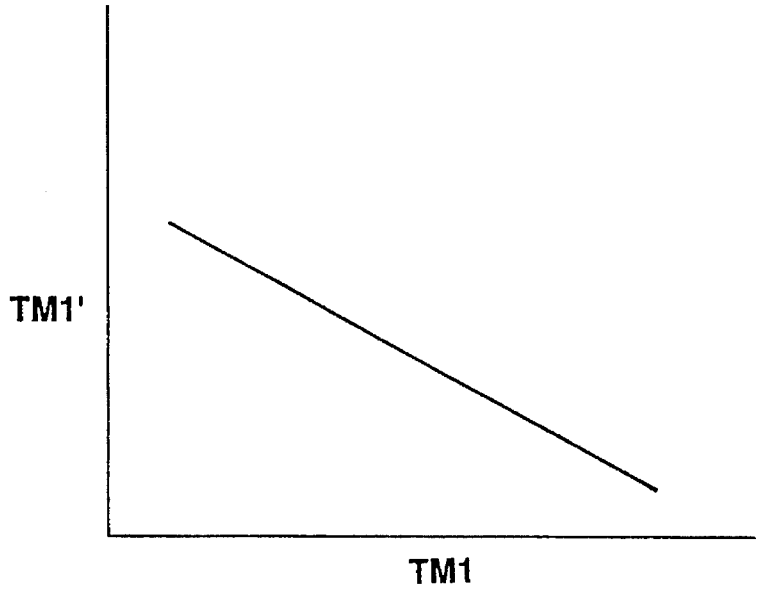
FIG. 3 is a graphical representation of a table used in the flow diagram.
Figure 4:
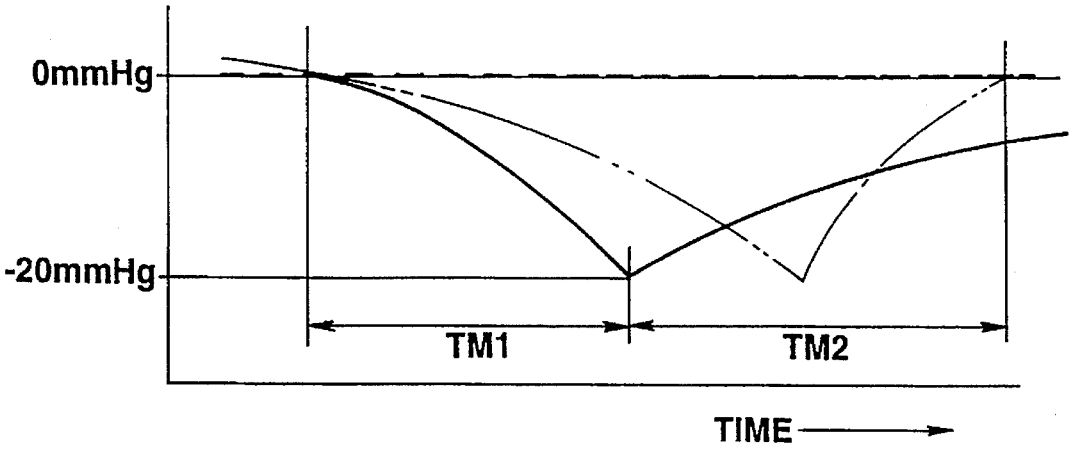
FIG. 4 is a time chart in which a broken line shows a pressure decay if the purge flow path of the system is clogged, a one-dot chain line shows a pressure decay if there is a leak, and a fully drawn line shows a pressure decay if there is no leak nor clog.

A diagnostic test of the purge system 10 identifies any leak in the purge flow path that would cause fuel vapor to escape to atmosphere and any clog in the purge flow path. The test is run by closing the canister vent valve 32 and opening the purge shut off valve 40, bypass valve 36 and canister purge valve 24, thus applying vacuum to the purge system and observing if a target vacuum, e.g., –20 mmHg, is reached within a target vacuum build time t, e.g., 30 seconds, and the vacuum is held. The test is considered to have been passed if the system 10 can hold the applied vacuum for a target vacuum hold time TM1'. The target vacuum hold time TM1' varies and is inversely proportional to an actual vacuum hold time TM1 taken until the target vacuum is reached (see FIG. 3). The relationship in FIG. 3 has been determined taking into account varying rate of flow of purge gas through the purge flow path with varying conditions. That is, if the rate of flow of purge gas is low, the actual vacuum hold time TM1 is short and the target vacuum hold time TM1' during which the system is expected to hold the vacuum is long, while if the rate of flow is high, the actual vacuum hold time TM1 is long and the target vacuum hold time TM1' is short. In FIG. 4, the fully drawn line illustrates observed track of vacuum when the test has been passed. One-dot chain line illustrates observed track of vacuum when there is a leak in the purge flow path. Broken line illustrates track of vacuum when there is a clog in the purge flow path.

Preferrably, the test should begin after confirming that the test has not been-run this trip. The test will begin if all of the following entry conditions are met: 1) the engine coolant temperature is above a calibrated minimum value indicating that the engine warm-up has been completed; 2) the tank fuel temperature is above a calibrated minimum value, e.g., –10° C.; 3) the engine load and speed are within calibrated windows excluding engine high speed and high load condition.

There are three test phases. The first phase is a vacuum application phase. An attempt is made to apply vacuum in the induction passage 26 to the purge system 10. The purge shut off valve 40 and canister purge valve 24 are opened to apply engine vacuum to the purge flow path. At this time the canister vent valve 32 is closed to isolate the canister 16 from the atmosphere and the bypass valve 36 is opened to allow application of vacuum to the fuel tank 12. Pressure in the purge flow path is monitored by the tank mount pressure sensor 54. If the target vacuum, e.g., –20 mmHg, is not reached within a target vacuum build time t, e.g. 30 seconds, it is observed how much the pressure has dropped toward the target vacuum by comparing the detected pressure P with a preset vacuum P1. If the preset vacuum P1 is not reached after elapse of the vaccum build time t, a clog is considered to have occurred in the purge flow path (see the dotted line in FIG. 4), and a code indicating that the system is clogged is recorded in a memory. If the preset vacuum P1 is reached after elapse of the target vacuum build time t, a large leak is considered to have occurred in the purge flow path, and a code is recorded in the memory indicating that the system is leaked. If the target vacuum is reached, within the vaccum build time t, the purge valve 24 is closed and an actual vacuum build time TM1 taken is stored and the phase 2 is entered.

Phase two is the vacuum hold phase. This phase tests the capability of the system 10 to hold the applied vacuum. The relationship of FIG. 3 is used to determine a vacuum hold time TM1' during which the purge system is expected to hold the applied vacuum. Both the canister purge valve 24 and canister vent valve 32 are held closed with the purge shut off valve 40 and bypass valve 36 held open. If, after the target vaccum hold time TM1', the vacuum in the purge system 10 is held lower than a calibrated window defined by 5 mmHg and –5 mmHg, the test is considered to have been passed, and a code is stored in the memory indicating that the system is OK. 0n the other hand, if the purge system 10 is unable to retain the vacuum so that the vacuum falls in the calibrated window, a code indicating that the system is leaked is recorded in the memory.

Phase three is the end of test. This final phase of the test returns the purge system 10 to normal engine purge. The canister vent valve 32 is opened and the bypass valve 36 is closed, while the purge shut off valve 40 and canister purge valve 24 are returned to positions determined by the control unit 58.

The control unit 58 can isolate the purge system 10 to prevent fuel vapor from escaping to the atmosphere after checking whether any fault code has been recorded in the memory.

Figure 2:
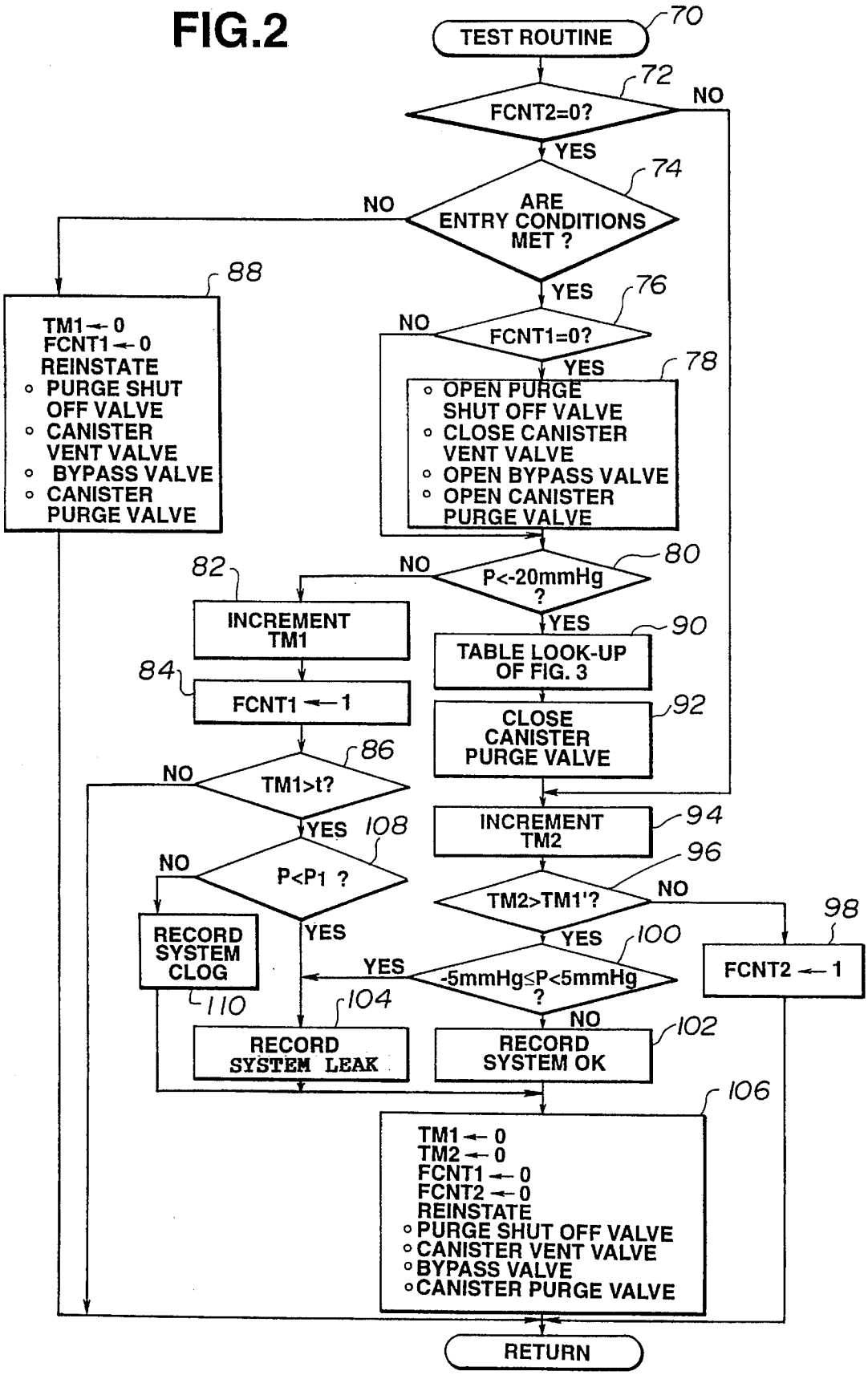
FIG. 2 is a flow diagram of an evaporative purge system monitor strategy.

Referring to FIG. 2, the purge system monitor strategy flow diagram begins at an enter block 70. Logic flow then goes to a decision block 72 where an interrogation is made as to whether a flag FCNT2 is reset. Since the flag FCNT2 is considered to have been reset prior to entry of test, the interrogation at the decision block 72 results in affirmative and logic flow goes to a decision block 74. In the block 74, an interrogation is made as to whether the before mentioned entry conditions are met. If the answer is affirmative, logic flow goes to a decision block whether an interrogation is made as to whether a flag FCNT1 is reset. Initially, the flag FCNT1 is reset. Logic flow goes to a block where the purge shut off valve 40 is opened, canister vent valve 32 is closed, bypass valve 36 is opened and canister purge valve 24 is opened, initiating application of vacuum to the purge system 10. Logic flow then goes to a decision block 80 where an interrogation is made as to whether the detected pressure P by the pressure sensor 54 is lower than or below the target vacuum of –20 mmHg. If the answer is no, logic flow goes to a block 82 where the value of an actual vacuum build timer TM1, which has been reset and has a zero value, is incremented by a unit amount and then goes to a block 84 where the flag FCNT1 is set. Logic flow goes to a decision block 86 where an interrogation is made as to whether the current value of the actual vacuum build timer TM1 is greater than a target vacuum build time t, e.g., 30 seconds. If TM1 is not greater than 5, logic flow returns to the enter block 70 to wait for the subsequent run which is initiated after a predetermined time.

In the subsequent run, the interrogation at the decision block 72 results in affirmative and the interrogation is made again as to whether the entry conditions are met. The interrogation in the block 74 will be repeated to examine whether the entry conditions are retained after the test has entered the first phase of vacuum application. If the entry conditions are not retained after the test has entered the vaccum application phase, the test is immediately terminated. In this case, the interrogation in the decision block 74 results in negative and logic flow goes to a block 88 where the actual vacuum build timer TM1 and flag FCNT1 are reset, and the canister vent valve 32 is opened and bypass valve 36 is closed, while the purge shut off valve 40 and canister purge valve 24 are returned to positions which the control unit 58 determines to meet the engine control strategy.

If the entry conditions are retained, logic flow goes to the block 76, block 80, block 82, block 84 and block 86. Execution of this flow is repeated until the detected pressure P drops below a target vacuum of −20 mmHg (see block 80) within the target vacuum build time t (see step 86). Upon or immediately after the detected pressure P drops below the target vacuum of −20 mmHg, the second phase of test is entered.

The second phase begins at a block 90 where a table look-up opration of FIG. 3 is conducted using the current or final value of actual vacuum build timer TM1 in order to find or determine a target vacuum hold time TM1'. Logic flow then goes to a block 92 where the canister purge valve 24 is closed. These blocks 90 and 92 are executed once upon entry of the second phase. Logic flow goes to a step 94 where the value of an actual vacuum hold timer TM2 is incremented by a unit amount. Logic flow goes to a decision block 96 where an interrogation is made as to whether the current value of timer TM2 is greater than the target vacuum hold time TM1'. Logic flow then goes to a block 98 where a flag FCNT2 is set and returns to the enter block 70. After the flag FCNT2 has been set, logic flow goes to block 72, block 94, block 96 and block 98. Execution of this flow is repeated until the value of timer TM2 exceeds the target vacuum hold time TM1'.

If, in the block 96, the current value of actual vacuum hold timer TM2 exceeds the target vacuum hold time TM1', logic flow goes to a block 100 where an interrogation is made as to whether the detected pressure P falls in a calibrated window defined by a lower limit of −5 mmHg and an upper limit of 5 mmHg. If the interrogation results is negative, logic flow goes to a block 102 where a code indicatiing that the purge system 10 is OK is recorded in a memory. In other words, the vacuum P in the purge fluid flow path is retained below the calibrated window during the target vaccum hold time TM1', and the test is considered to have been passed. On the other hand, if the vacuum P falls in the predetermined window, the interrogation at the block 100 results in affirmative and logic flow goes to a block 104 where a fault code indicating that the system is leaked is recorded in the memory. In other words, the purge flow path is considered to have been leaked.

Logic flow then goes to a block 106, entering the third and final phase of test. In the block 106, all of the timers and flags TM1, TM2, FCNT1 and FCNT2 are reset, the canister vent valve 32 is opened and the bypass valve 36 is closed, while the purge shut off valve 40 and canister purge valve 24 are returned to positions which the control unit 58 determines to meet the engine control strategy.

If the purge flow path is clogged, the target vacuum of −20 mmHg is not reached within the target vacuum build time t in the second or vacuum application phase (see the broken line in FIG. 4). If the target vacuum of −20 mmHg is not reached within the target vacuum build time t (see block 80), logic flow goes to a decision block 108 where an interrogation is made as to whether the pressure P has reached a preset vacuum P1 of −5 mmHg. The setting is such that the case wherein there is a clog in the purge flow path can be identified as different from the case wherein there is a great leak in the purge flow path by comparing the pressure P with this value P1. It is understood that, owing to evaporation of fuel, the pressure P cannot drop considerably below the atmospheric level if the path is clogged. If, after elapse of the vacuum build time t, the pressure P fails to reach the vacuum P1, the interrogation in block 108 results in negative and logic flow goes to a block 110 where a code indicating that the system is clogged is recorded in the memory. If the interrogation in the block 108 results in affirmative, it is assumed that there is a great leak in the purge flow path and logic flow goes to the block 104 where the code that the system is leaked is recorded. Logic flow goes to the block 106 to end the test.

If the purge flow path has a large leak hole or the purge flow rate is high, it takes a considerably long time for the pressure P to drop during the vaccum application phase. It is confirmed that, during the vacuum application, the pressure drop tendency owing to a great leak through the large hole or the high rate of purge flow can be distinguished from a pressure drop tendency owing to the occurrence of clogging in the purge flow path. It is also confirmed that the distinction can be made by appropriately setting the value P1 and vaccum build time t in accordance with the specifications of evaporative purge system to be monitored.

In the evaporative purge system of FIG. 1, the diaphragm actuated valve 18 and purge shut off valve 40 are employed in addition to the canister purge valve 24 and the check valve 34 and bypass valve 36 are employed. Such valves 18 and 40 may be eliminated if the canister 16 is directly coupled with the purge line 22. The check valve 34 and bypass valve 36 may be eliminated from the fuel vapor line 14. In such modified evaporative purge system, the vacuum application phase of the test is initiated by closing the canister vent valve 32 and opening the canister purge valve 24, and the vacuum hold phase is entered by closing the canister purge valve 24 with the canister vent valve 32 held closed. In other words, the invention is not limited to the evaporative purge system of FIG. 1.

What is claimed is:

1. An evaporative purge system for an engine having an air induction passage, comprising:

a canister having a canister vent valve;

a fuel tank coupled to said canister;

a purge line connected to said canister;

a canister purge valve fluidly connected between said purge line and the induction passage;

a pressure sensor providing a signal indicative of a pressure in the evaporative purge flow path; and control unit means operative to close said canister vent valve and open said canister purge valve if predetermined entry conditions are met in order to apply a vacuum to an evaporative purge flow path to initiate a vacuum application phase, said control unit means being operative to count time elapsed from beginning of the vacuum application phase and identify a clog in the evaporative purge flow path in response to the counted time elapsed from the beginning of the vacuum application phase and the signal indicative of the pressure;

said control unit means being operative to determine an actual vacuum build time that has passed from the beginning of the vacuum application phase to the moment when the signal indicative of the pressure reaches a target vacuum if the signal indicative of the pressure has reached the target vacuum within a target vacuum build time, and to determine a target vacuum hold time as a function of the determined actual vacuum build time;

said control unit means being operative to close the canister purge valve with the canister vent valve held closed to hold the vacuum in the evaporative purge flow path after the signal indicative of the pressure has reached the target vacuum; and said control unit means being operative to identify a leak in the evaporative purge flow path if the signal indicative of the pressure indicates a vacuum less negative than a preset vacuum that is less negative than the target vacuum upon elapse of the determined target vacuum hold time, and identify that the test has been passed if the signal indicative of the pressure indicates a vacuum greater negative than the preset vacuum.

2. An evaporative purge system as claimed in claim 1, wherein the target vacuum hold time is inversely proportional to the determined vacuum build time.

3. An evaporative purge system for an engine having an air induction passage, comprising:

a canister having a canister vent valve;

a fuel tank coupled to said canister;

a purge line connected to said canister;

a canister purge valve fluidly connected between said purge line and the induction passage;

a pressure sensor providing a signal indicative of a pressure in the evaporative purge flow path; and control unit means operative to close said canister vent valve and open said canister purge valve if predetermined entry conditions are met in order to apply a vacuum to an evaporative purge flow path to initiate a vacuum application phase, said control unit means being operative to count time elapsed from beginning of the vacuum application phase to the moment when the signal indicative of the pressure reaches a target vacuum, and to determine a target vacuum hold time as a function of the determined actual vacuum build time;

said control unit means being operative to close the canister purge valve with the canister vent valve held closed to hold the vacuum in the evaporative purge flow path after the signal indicative of the pressure has reached the target vacuum; and said control unit means being operative to identify a leak in the evaporative purge flow path if the signal indicative of the pressure indicates a vacuum less negative than a preset vacuum that is less negative than the target vacuum upon elapse of the determined target vacuum hold time, and identify that the test has been passed if the signal indicative of the pressure indicates a vacuum greater negative than the preset vacuum.

4. A method of monitoring an evaporative purge flow path, comprising the steps of:

closing a canister vent valve to the atmosphere and opening a canister purge valve positioned between an engine induction passage and an evaporative purge flow path of a fuel tank in order to apply a vacuum to the evaporative purge flow path to initiate a vacuum application phase;

waiting a target vacuum build time;

determining whether a target vacuum has been reached within the target vacuum build time;

determining an actual vacuum build time that has passed from the beginning of the vacuum application phase to the moment when the target vacuum is reached;

determining a target vacuum hold time as a function of the determined actual vacuum build time, and closing the canister purge valve with the canister vent valve held closed to hold the vacuum in the evaporative purge flow path;

waiting the determined target vacuum hold time;

determining whether the vacuum is retained in the evaporative purge flow path for the determined target vacuum hold time;

identifying a leak in the evaporative purge flow path if the vacuum fails to be retained for the determined target vacuum hold time; and identifying that the test has been passed if the vacuum is retained for the determined target vacuum hold time.

5. A method of monitoring an evaporative purge flow path, comprising the steps of:

closing a canister vent valve to the atmosphere and opening a canister purge valve positioned between an engine induction passage and an evaporative purge flow path of a fuel tank in order to apply a vacuum to the evaporative purge flow path to initiate a vacuum application phase;

waiting a target vacuum build time;

determining whether a target vacuum has been reached within the target vacuum build time;

determining whether a preset vacuum, which is less negative pressure than the target vacuum, is reached after elapse of the target vacuum build time if the target vacuum is not reached within the target vacuum build time;

identifying a clog in the evaporative purge flow path if the target vacuum is not reached within the target vacuum build time during the vacuum application phase and the preset vacuum is not reached after elapse of the target vacuum build time;

identifying a leak in the evaporative purge flow path if the target vacuum is not reached within the target vacuum build time during the vacuum application phase but the preset vacuum is reached after elapse of the target vacuum build time;

if the target vacuum has been reached within the target vacuum build time, determining an actual vacuum build time that has passed from the beginning of the vacuum application phase to the moment when the target vacuum is reached, and determining a target vacuum hold time as a function of the determined actual vacuum build time, and closing the canister purge valve with the canister vent valve held closed to hold the vacuum in the evaporative purge flow path;

waiting the determined target vacuum hold time;

determining whether the vacuum is retained in the evaporative purge flow path for the determined target vacuum hold time;

identifying a leak in the evaporative purge flow path if the vacuum fails to be retained for the determined target vacuum hold time; and identifying that the test has been passed if the vacuum is retained for the determined target vacuum hold time.

* * * * *

UNITED STATES PATENT AND TRADEMARK OFFICE

CERTIFICATE OF CORRECTION

PATENT NO. : 5,494,021

DATED : February 27, 1996

INVENTOR(S) : Shuichi Yoneyama

It is certified that error appears in the above-indentified patent and that said Letters Patent is hereby corrected as shown below:

On the title page, after item [22] insert item [30] as follows:

--[30] Foreign Application Priority Data

Sep. 16, 1993 [JP] Japan . . . . 5-230498--.

Signed and Sealed this

Third Day of September, 1996

Bruce Lehman

*Attest:*

BRUCE LEHMAN

*Attesting Officer*

*Commissioner of Patents and Trademarks*